US005588624A

United States Patent [19]

Woodham

[11] Patent Number: 5,588,624

[45] Date of Patent: Dec. 31, 1996

[54] TABLE LEG EXTENSION

[76] Inventor: Annie R. Woodham, 297 Batiste Way, Jonesboro, Ga. 30236

[21] Appl. No.: 417,194

[22] Filed: Apr. 5, 1995

[51] Int. Cl.[6] ..... F16M 11/24

[52] U.S. Cl. ..... 248/188.4; 248/188.5

[58] Field of Search ..... 248/188.2, 188.4, 248/188.5, 650; 182/201

[56] References Cited

U.S. PATENT DOCUMENTS

| | | | |
|---|---|---|---|
| 2,213,471 | 9/1940 | Minnick | 182/201 |
| 2,338,092 | 1/1944 | Brown | 248/188.4 |
| 2,695,800 | 11/1954 | Souc | 248/188.4 |
| 2,750,709 | 6/1956 | Saverino | 248/188.2 |
| 3,031,689 | 5/1962 | Sark | 248/188.4 |
| 3,232,253 | 2/1966 | Winters | 248/188.2 |
| 5,142,734 | 9/1992 | Looman | 248/188.4 |
| 5,292,095 | 3/1994 | Cattaneo | 248/650 |

*Primary Examiner*—Karen J. Chotkowski
*Assistant Examiner*—Gwendolyn A. Wrenn

[57] ABSTRACT

An extension for supporting a leg of a table to increase a distance of the table from a ground surface. The inventive device includes a receiving tube within which a leg of a table can be positioned. An abutment plate is mounted within the tube and engages the table leg to support the leg in a spaced relationship relative to a lower end of the tube. An adjustment assembly can be provided for permitting selective manual adjustment of the table height.

5 Claims, 3 Drawing Sheets

TABLE LEG EXTENSION

BACKGROUND OF THE INVENTION

1. Field of the Invention

The present invention relates to table structures and more particularly pertains to a table leg extension for supporting a leg of a table to increase a distance of the table from a ground surface.

2. Description of the Prior Art

The use of table structures is known in the prior art. More specifically, table structures heretofore devised and utilized are known to consist basically of familiar, expected and obvious structural configurations, notwithstanding the myriad of designs encompassed by the crowded prior art which have been developed for the fulfillment of countless objectives and requirements.

While the prior art table structures fulfill their respective, particular objectives and requirements, the prior art does not disclose a table leg extension for supporting a leg of a table to increase a distance of the table from a ground surface which includes a receiving tube within which a leg of a table can be positioned, an abutment plate mounted within the tube and being engagable to the table leg so as to support the leg in a spaced relationship relative to a lower end of the tube, and an adjustment assembly for permitting selective manual adjustment of the table height.

In these respects, the table leg extension according to the present invention substantially departs from the conventional concepts and designs of the prior art, and in so doing provides an apparatus primarily developed for the purpose of supporting a leg of a table to increase a distance of the table from a ground surface.

SUMMARY OF THE INVENTION

In view of the foregoing disadvantages inherent in the known types of table structures now present in the prior art, the present invention provides a new table leg extension construction wherein the same can be utilized for increasing a height of a table. As such, the general purpose of the present invention, which will be described subsequently in greater detail, is to provide a new table leg extension apparatus and method which has many of the advantages of the table structures mentioned heretofore and many novel features that result in a table leg extension which is not anticipated, rendered obvious, suggested, or even implied by any of the prior art table structures, either alone or in any combination thereof.

To attain this, the present invention generally comprises an extension for supporting a leg of a table to increase a distance of the table from a ground surface. The inventive device includes a receiving tube within which a leg of a table can be positioned. An abutment plate is mounted within the tube and engages the table leg to support the leg in a spaced relationship relative to a lower end of the tube. An adjustment assembly can be provided for permitting selective manual adjustment of the table height.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new table leg extension apparatus and method which has many of the advantages of the table structures mentioned heretofore and many novel features that result in a table leg extension which is not anticipated, rendered obvious, suggested, or even implied by any of the prior art table structures, either alone or in any combination thereof.

It is another object of the present invention to provide a new table leg extension which may be easily and efficiently manufactured and marketed.

It is a further object of the present invention to provide a new table leg extension which is of a durable and reliable construction.

An even further object of the present invention is to provide a new table leg extension which is susceptible of a low cost of manufacture with regard to both materials and labor, and which accordingly is then susceptible of low prices of sale to the consuming public, thereby making such table leg extensions economically available to the buying public.

Still yet another object of the present invention is to provide a new table leg extension which provides in the apparatuses and methods of the prior art some of the advantages thereof, while simultaneously overcoming some of the disadvantages normally associated therewith.

Still another object of the present invention is to provide a new table leg extension for supporting a leg of a table in a spaced relationship relative to a ground surface.

Yet another object of the present invention is to provide a new table leg extension which includes a receiving tube within which a leg of a table can be positioned, an abutment plate mounted within the tube and being engagable to the table leg so as to support the leg in a spaced relationship relative to a lower end of the tube, and an adjustment assembly for permitting selective manual adjustment of the table height.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
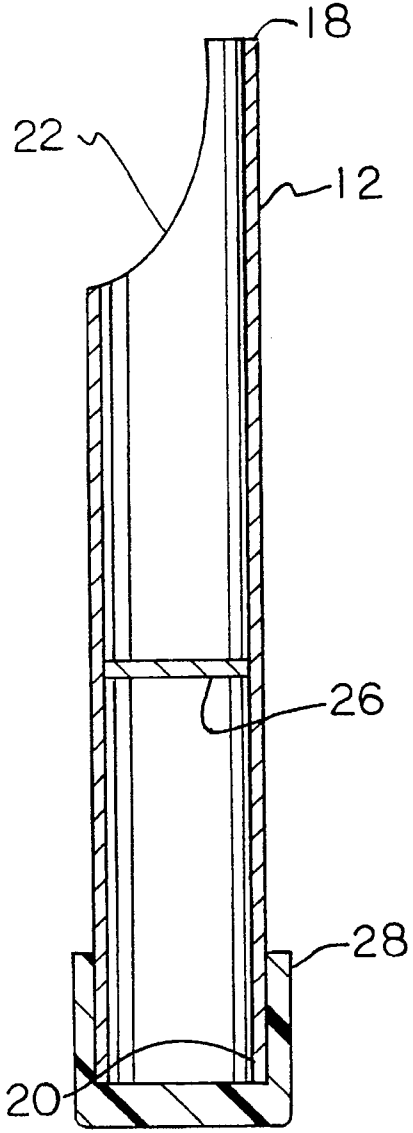
FIG. 2 is a cross-sectional view taken along line 2—2 of FIG. 1.

With reference now to the drawings, and in particular to FIGS. 1–6 thereof, a new table leg extension embodying the principles and concepts of the present invention and generally designated by the reference numeral 10 will be described.

Figure 1:
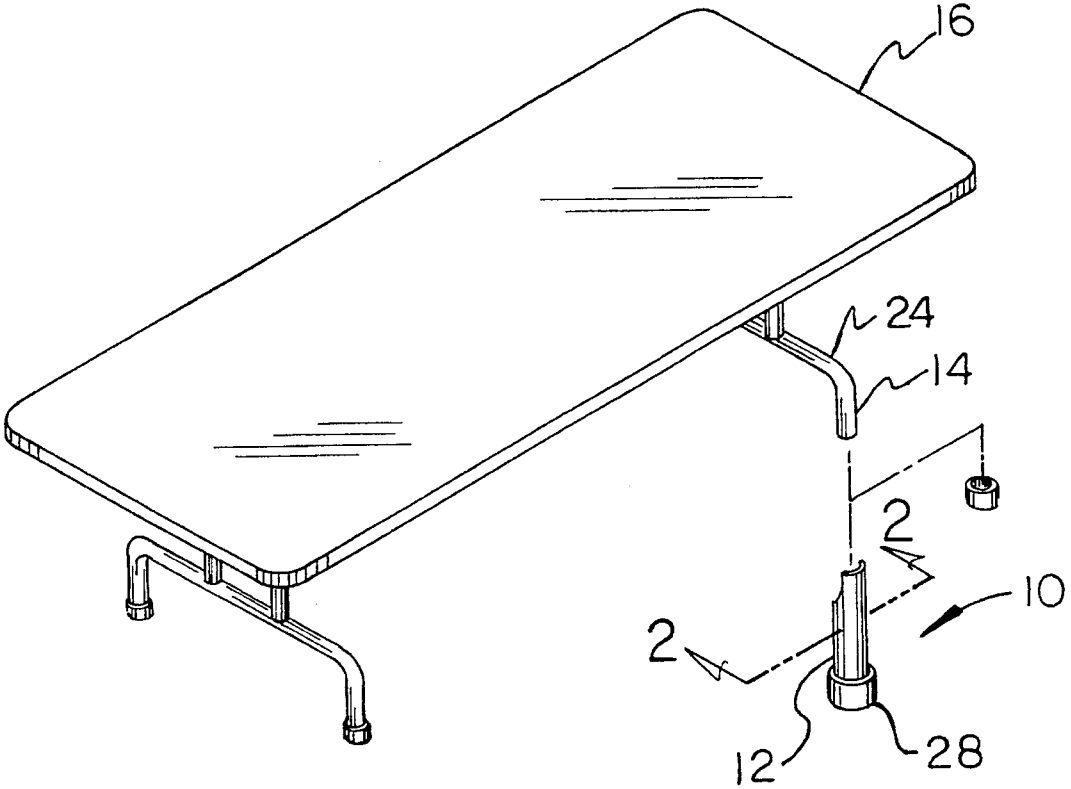
FIG. 1 is an isometric illustration of a table leg extension according to the present invention positioned for engagement with a leg of a table.

More specifically, it will be noted that the table leg extension 10 comprises a receiving tube 12 for receiving a leg 14 of a table 16 as shown in FIG. 1 of the drawings. The receiving tube 12 is shaped so as to define an upper end 18 spaced from a lower end 20, with an arcuate aperture 22 directed into the upper end thereof. The arcuate aperture 22 of the receiving tube 12 permits the upper end 18 to be bent or deformed over an integral bend 24 of the leg 14 of the table 16 so as to secure the device 10 relative thereto. An abutment plate 26 is mounted within the receiving tube 12 and engages a lower end of the leg 14 so as to support the lower end of the leg in a spaced relationship relative to the lower end of the receiving tube 12. An elastomeric foot 28 is secured to a lower end of the receiving tube 12 for engaging a ground surface beneath the table 16. By this structure, one or more legs 14 of the table 16 can be extended so as to position a top of the table 16 at a desired height relative to a ground surface.

Figure 3:
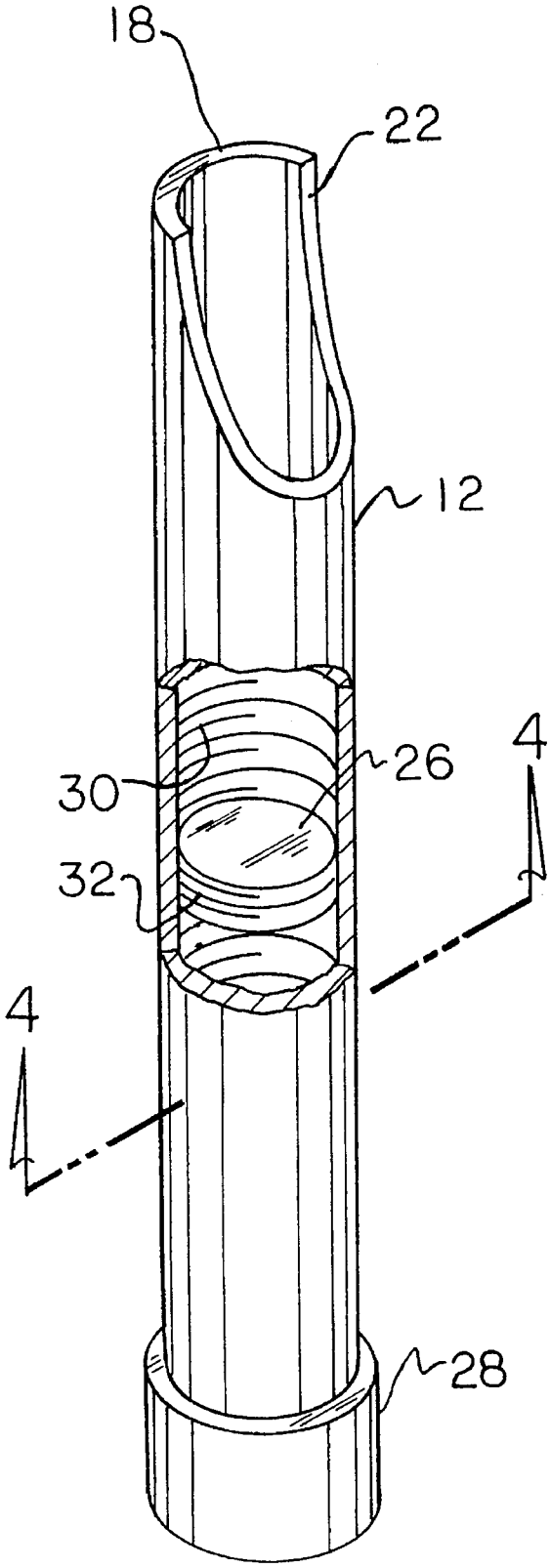
FIG. 3 is an isometric illustration, partially in cross-section, of the invention including an adjustment means.
Figure 4:
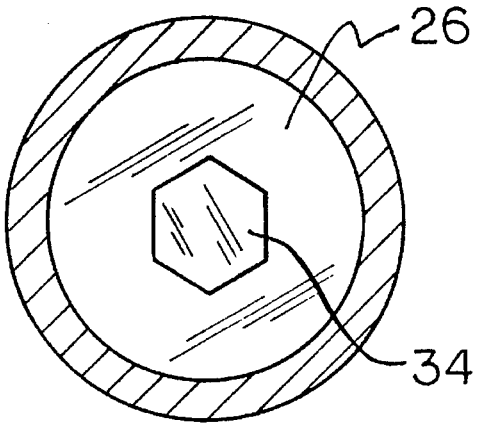
FIG. 4 is a cross-sectional view taken along line 4—4 of FIG. 3.

Referring now to FIG. 3, it can be shown that the receiving tube 12 can be shaped so as to define internal threads 30 extending about an internal surface thereof. The abutment plate 26 can similarly be shaped so as to define external threads 32 which are threadably engaged to the internal threads 30 of the receiving tube 12. The abutment plate 26, as shown in FIG. 4, desirably includes a tool receiving socket 34 for receiving a driving end of a hand tool so as to facilitate manual rotation of the abutment plate 26 to adjust an axial position thereof within the receiving tube 12. By this structure, a position of the abutment plate 26 within the receiving tube 12 can be selectively adjusted so as to facilitate adjustable positioning of the table 16 relative to the ground surface therebeneath.

Figure 5:
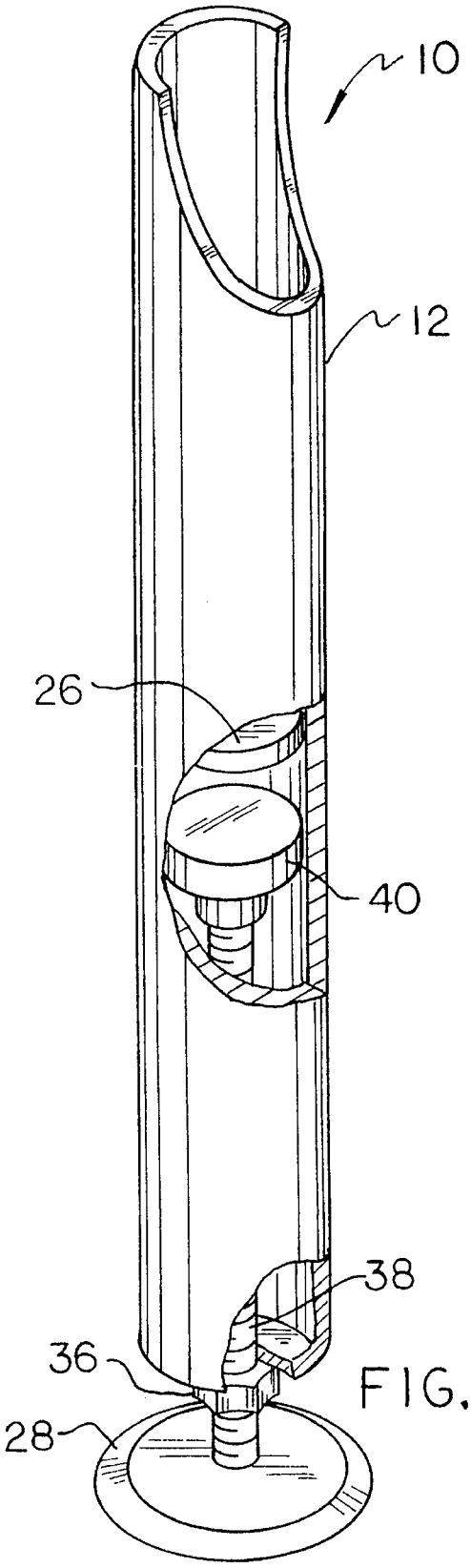
FIG. 5 is an isometric illustration, partially in cross-section, of the invention including an alternative form of the adjustment means.

Referring now to FIG. 5, wherein an alternative form of the adjustment means is illustrated, it can be shown that the abutment plate 26 can be fixedly secured within the receiving tube 12 with a securing nut 36 being coupled to the lower end 20 of the receiving tube 12. A threaded rod 38 is threadably engaged to the securing nut 36 and mounts the foot 28 at a lower end of the threaded rod. The threaded rod 38 can thus be adjusted relative to the securing nut 36 by rotatably advancing the threaded rod 38 relative thereto so as to position the toot 28 at a desired distance from the lower end of the receiving tube 12. If desired, a guide member 40 can be secured to the upper end of the threaded rod 38 and slidably positioned within the receiving tube 12 so as to maintain the threaded rod 38 within a center of the receiving tube.

Figure 6:
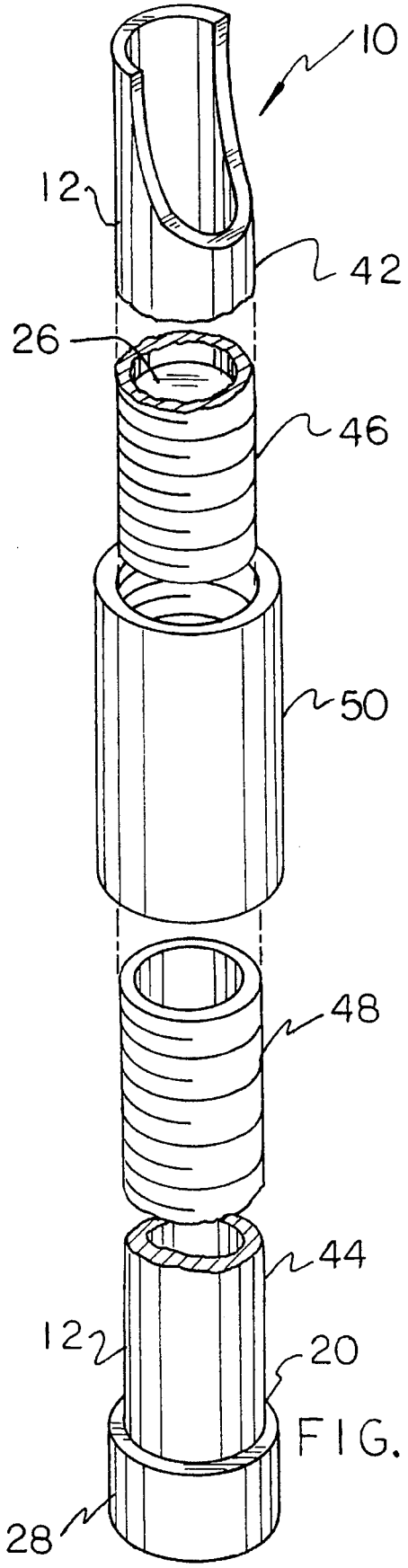
FIG. 6 is an exploded isometric illustration, partially in cross-section, of the invention including a further alternative form of the adjustment means.

As shown in FIG. 6, the adjustment means of the present invention 10 may further alternatively comprise separating the receiving tube 12 into an upper portion 42 and a lower portion 44. The upper portion 42 is provided with upper portion threads 46, with the lower portion 44 being similarly provided with lower portion threads 48. A coupler 50 is threadably engaged to the upper portion threads 46 and the lower portion threads 48 and permits the joining of the upper portion 42 to the lower portion 44 with a desired spacing therebetween. By this structure, the upper portion 42 or the lower portion 44 can be rotatably advanced relative to the coupler 50 so as to position the abutment plate 26 at a desired spacing from the lower end 20 of the receiving tube 12.

In use, the table leg extension 10 according to the present invention can be easily utilized for supporting a leg 14 of a table 16 in a desired spacing relative to a ground surface so as to position the top of the table 16 at a desired height therefrom. The adjustment means illustrated in FIGS. 3 through 6 permit an individual to selectively adjust the height of the device so as to adjustably position the top of the table 16 at a desired distance and/or accommodate the legs 14 of the table 16 to rough or uneven terrain.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A table leg extension comprising:

a receiving tube adapted for receiving a leg of a table, the receiving tube being shaped so as to define an upper end spaced from lower end, with an arcuate aperture directed into the upper end thereof, the arcuate aperture permitting the upper end of the receiving tube to be bent over an integral bend of the leg of the table, the receiving tube is shaped so as to define internal threads extending about an internal surface thereof;

an abutment plate mounted within the receiving tube and adapted to engage a lower end of the leg so as to support the lower end of the leg in a spaced relationship relative to the lower end of the receiving tube, and the abutment plate is shaped so as to define external threads which are threadably engaged to the internal threads of the receiving tube so as to define an adjustment means, the adjustment means adjustably positioning the abutment plate relative to a ground surface;

an elastomeric foot secured to the lower end of the receiving tube for engaging a ground surface.

2. The table leg extension of claim 1, wherein the abutment plate includes a tool receiving socket directed thereinto for receiving a driving end of a hand tool so as to facilitate rotation of the abutment plate to adjust an axial position thereof within the receiving tube.

3. The table leg extension of claim 1, wherein the adjustment means comprises a securing nut coupled to the lower end of the receiving tube; a threaded rod threadably engaged to the securing nut, the foot being mounted to a lower end of the threaded rod, whereby the threaded rod can be adjusted relative to the securing nut by rotatably advancing the threaded rod relative thereto so as to position the foot at a desired distance from the lower end of the receiving tube.

4. The table leg extension of claim 3, wherein the adjustment means further comprises a guide member secured to an upper end of the threaded rod and slidable positioned within the receiving tube so as to maintain the threaded rod within a center of the receiving tube.

5. The table leg extension of claim 1, wherein the adjustment means comprises separating the receiving tube into an upper portion and a lower portion, the upper portion including upper portion threads, with the lower portion including lower portion threads; and a coupler threadably engaged to the upper portion threads and the lower portion threads so as to permit the joining of the upper portion to the lower portion with a desired spacing therebetween.

* * * * *